US006385294B2

(12) United States Patent
Suzuki et al.

(10) Patent No.: US 6,385,294 B2
(45) Date of Patent: May 7, 2002

(54) X-RAY TUBE

(75) Inventors: Kenji Suzuki; Tadaoki Matsushita; Tutomu Inazuru, all of Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 0 days.

(21) Appl. No.: 09/771,721

(22) Filed: Jan. 30, 2001

Related U.S. Application Data

(63) Continuation-in-part of application No. PCT/JP99/03676, filed on Jul. 7, 1999.

(30) Foreign Application Priority Data

Jul. 30, 1998 (JP) ..... P10-215654

(51) Int. Cl.[7] ..... H01J 35/06
(52) U.S. Cl. ..... 378/136; 378/121
(58) Field of Search ..... 378/121, 136, 378/139; 313/238, 271, 275, 276, 277, 331, 332, 341

(56) References Cited

U.S. PATENT DOCUMENTS

| | | | | | |
|---|---|---|---|---|---|
| 3,943,393 | A | * | 3/1976 | Naill | 313/331 |
| 5,517,545 | A | | 5/1996 | Nakamura et al. | 378/101 |
| 5,526,396 | A | * | 6/1996 | Jacob | 378/121 |
| 5,563,923 | A | | 10/1996 | Okada et al. | 378/138 |

* cited by examiner

*Primary Examiner*—David P. Porta
(74) *Attorney, Agent, or Firm*—Morgan, Lewis & Bockius LLP

(57) ABSTRACT

An X-ray tube 1 in which a cathode 73 is heated to emit electrons 80, and the electrons 80 are bombarded against an anode target 32, thereby generating X-rays 81, includes a stem substrate 4 mounted on an opening 22 of a container 21 housing the cathode 73, a plurality of pins 5 extending through the insulating substrate 4 and adapted to supply a voltage into the container 21, and pin covers 6 mounted on the pins 5 in the container 21 and arranged at positions away from a surface of the stem substrate 4 to cover base portions of the pins 5.

3 Claims, 3 Drawing Sheets

X-RAY TUBE

RELATED APPLICATIONS

The present application is a continuation-in-part application of PCT application No. PCT/JP99/03676 filed on Jul. 7, 1999, designating U.S.A. and now pending.

BACKGROUND OF THE INVENTION

1. Field of the Invention

The present invention relates to an X-ray tube for generating X-rays.

2. Related Background Art

In an X-ray tube, a cathode is heated in a high-vacuum tube to emit electrons, and the electrons are bombarded against an anode target to which a high voltage is applied, thereby generating X-rays. X-ray tubes with various structures are available depending on applications. A predetermined voltage must be supplied to the tube from the outside in order to apply a voltage to a heater, grid electrode, and the like. For this purpose, as described in Japanese Utility Model Laid-Open No. 5-11302 and Japanese Patent Laid-Open Nos. 9-180630 and 9-180660, a plurality of pins made of a conductor extend through an insulating stem, and a predetermined voltage is supplied into the tube of the X-ray tube through them.

SUMMARY OF THE INVENTION

In the X-ray tube described above, insulation among the pins is impaired by long-time use, and the operation of the X-ray tube accordingly becomes unstable. It is, therefore, an object of the present invention to provide an X-ray tube in which the above problem is solved and which operates stably even after long-time use.

In order to solve the above problem, according to the present invention, there is provided an X-ray tube in which a cathode is heated to emit electrons, and the electrons are bombarded against an anode target, thereby generating X-rays, characterized by comprising an insulating substrate mounted on an opening portion of a container housing the cathode, a plurality of pins extending through the insulating substrate and adapted to supply a voltage into the container, and pin covers mounted on the pins in the container and arranged at positions away from a surface of the insulating substrate to cover base portions of the pins.

With the present invention, even when the heater, cathode, and the like heated to a high temperature produce conductive debris due to long-time use, the debris does not attach to the base portions of the pins because of the presence of the pin covers. Accordingly, even if the debris attaches to the surface of the insulating substrate, it does not impair insulation among the pins. Thus, even after long-time use, the X-ray tube can operate stably without being adversely affected by the debris generated by the usage.

DESCRIPTION OF THE PREFERRED EMBODIMENTS

Figure 1:
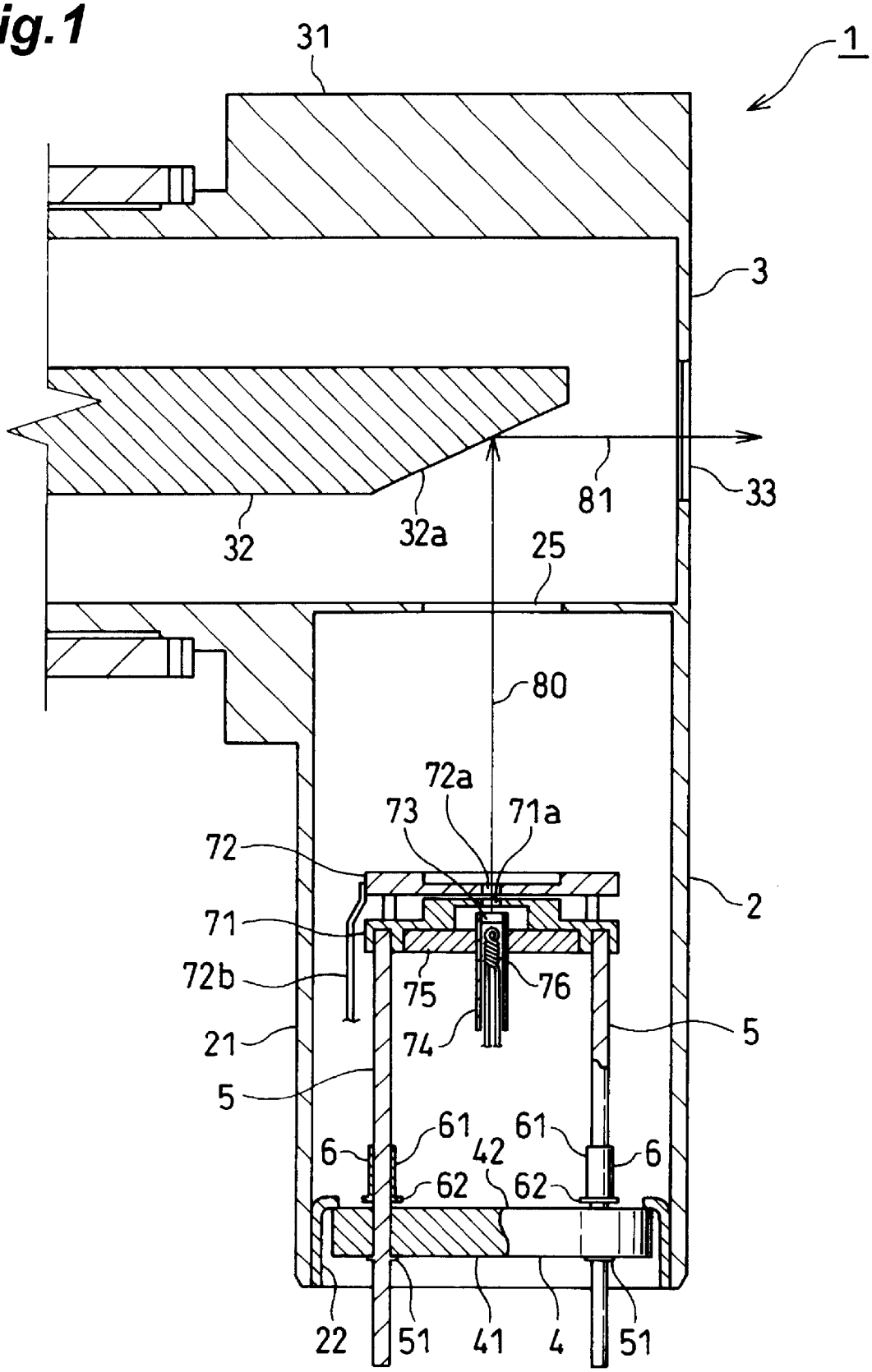
FIG. 1 is a view for explaining an X-ray tube according to the first embodiment.

The embodiments of the present invention will be described with reference to the accompanying drawings.

Note that in the drawings, identical elements are denoted by the same reference numerals, and a description will be omitted. The dimensional proportion of the drawings does not always coincide with that of the description.

(First Embodiment)

FIG. 1 shows an X-ray tube according to the first embodiment. As shown in FIG. 1, an X-ray tube 1 is a microfocus X-ray tube and has an electron gun portion 2 for generating and emitting electrons, and an X-ray generating portion 3 for generating X-rays upon being bombarded by the electrons from the electron gun portion 2.

The electron gun portion 2 has a container 21 for housing its constituent components. An opening portion 22 is formed at the end of the container 21. A stem substrate 4 is attached to the opening portion 22. The stem substrate 4 is fixed to the opening portion 22 by brazing or the like in order to seal the container 21. The stem substrate 4 is made of a nonconductive insulator, e.g., a ceramic material.

A plurality of pins 5 extend through the stem substrate 4. The pins 5 serve to supply a predetermined voltage into the container 21 from the outside. Collars 51 are formed to project from the outer surfaces of the pins 5. The collars 51 abut against an outer surface 41 of the stem substrate 4. The collars 51 and stem substrate 4 are brazed to each other, so that the pins 5 are fixed to the stem substrate 4. FIG. 1 shows only the pins 5 that apply a voltage to a first grid electrode 71 for the sake of descriptive convenience, and the pins 5 that apply a voltage to a second grid electrode 72, cathode 73, heater 76, and the like are omitted.

Pin covers 6 are mounted on those portions of the pins 5 which are located in the container 21. Each pin cover 6 is comprised of a cylindrical portion 61 mounted on the pin 5 and a flange 62 projecting outward from the cylindrical portion 61. The cylindrical portion 61 has an inner diameter substantially the same as the outer diameter of the pin 5. The pin cover 6 is fixed to the pin 5 by crushing the cylindrical portion 61. With the cylindrical portion 61, the pin cover 6 can be fixed at an accurate position easily.

The flange 62 covers at least the base portion of the pin 5. As described above, since the collars 51 abuts against the outer surface 41 of the stem substrate 4 and is not located on an inner surface 42 of the stem substrate 4, that portion of the pin 5 which is to be covered with the flange 62 can be small, so the projecting length of the flange 62 from the cylindrical portion 61 can be small. Even if the pins 5 are disposed at a small distance from each other, the pin covers 6 will not come into contact with each other, and insulation among the pins 5 can be assured reliably.

The pin covers 6 are arranged such that their flanges 62 are at a constant predetermined distance from the inner surface 42 of the stem substrate 4. The separation distance between the flanges 62 and inner surface 42 may be set, considering the diameters of the pins 5, the projection lengths of the flanges 62, and the like, such that a debris generated during use of the X-ray tube 1 will not attach to the base portions of the pins 5 through this distance.

The ends of the pins 5 in the container 21 are connected to the first grid electrode 71. The first grid electrode 71 has an opening 71*a* at its central portion so electrons 80 can pass through it. The second grid electrode 72 is disposed on the first grid electrode 71 on the X-ray generating portion 3 side. The second grid electrode 72 is supported by the first grid electrode 71 through an insulator. The second grid electrode 72 has an opening 72*a* at its central portion so the electrons 80 can pass through it. The second grid electrode 72 is connected to a lead wire 72*b*. A voltage is applied to the lead wire 72*b* from the outside of the container 21 through the pin 5 (not shown).

The cathode 73 is disposed on the first grid electrode 71 on the stem substrate 4 side. The cathode 73 is formed at the distal end of a cylinder 74 made of an insulator. The cylinder 74 is supported by the first grid electrode 71 through a spacer 75 made of an insulator. A predetermined voltage can be supplied to the cathode 73 from the outside through a lead wire and pin (not shown).

The heater 76 is disposed in the cylinder 74. The heater 76 serves to heat the cathode 73, and a predetermined voltage is supplied to it from the outside through a lead wire and pin (not shown).

The X-ray generating portion 3 has a container 31 for housing its constituent components. The container 31 communicates with the container 21 of the electron gun portion 2 through an opening 25, so the electrons 80 emitted from the cathode 73 can enter the container 31. The containers 31 and 21 are sealed, so that their interiors are maintained substantially in a vacuum state.

A target 32 is set in the container 31. The target 32 generates X-rays 81 upon being bombarded by the electrons 80 from the electron gun portion 2. The target 32 is a metal rod-like body, and is arranged such that its axial direction intersects a direction in which the electrons 80 enter. A distal end face 32*a* of the target 32 is a surface that receives the electrons 80 from the electron gun portion 2, and is arranged at a position in front of the entering electrons 80. A positive high voltage is applied to the target 32.

The container 31 has an X-ray exit window 33. The X-ray exit window 33 is a window for emitting the X-rays 81 generated by the target 32 to the outside of the container 31, and is formed of, e.g., a plate body or the like made of a Be material as an X-ray transmitting material. The X-ray exit window 33 is arranged in front of the distal end of the target 32. The X-ray exit window 33 is formed such that its center is located on the extension of the central axis of the target 32.

The operation of the X-ray tube 1 will be described.

Referring to FIG. 1, a predetermined voltage is applied to the first and second grid electrodes 71 and 72 through the pins 5 and the like, and a positive high voltage is applied to the target 32. In this state, when the heater 76 is heated, the cathode 73 emits electrons 80. The electrons 80 pass through the openings 71*a* and 72*a* and become incident on the distal end face 32*a* of the target 32. Upon incidence of the electrons 80, the distal end face 32*a* emits the X-rays 81. The X-rays 81 are emitted to the outside of the X-ray tube 1 through the X-ray exit window 33.

Figure 2:
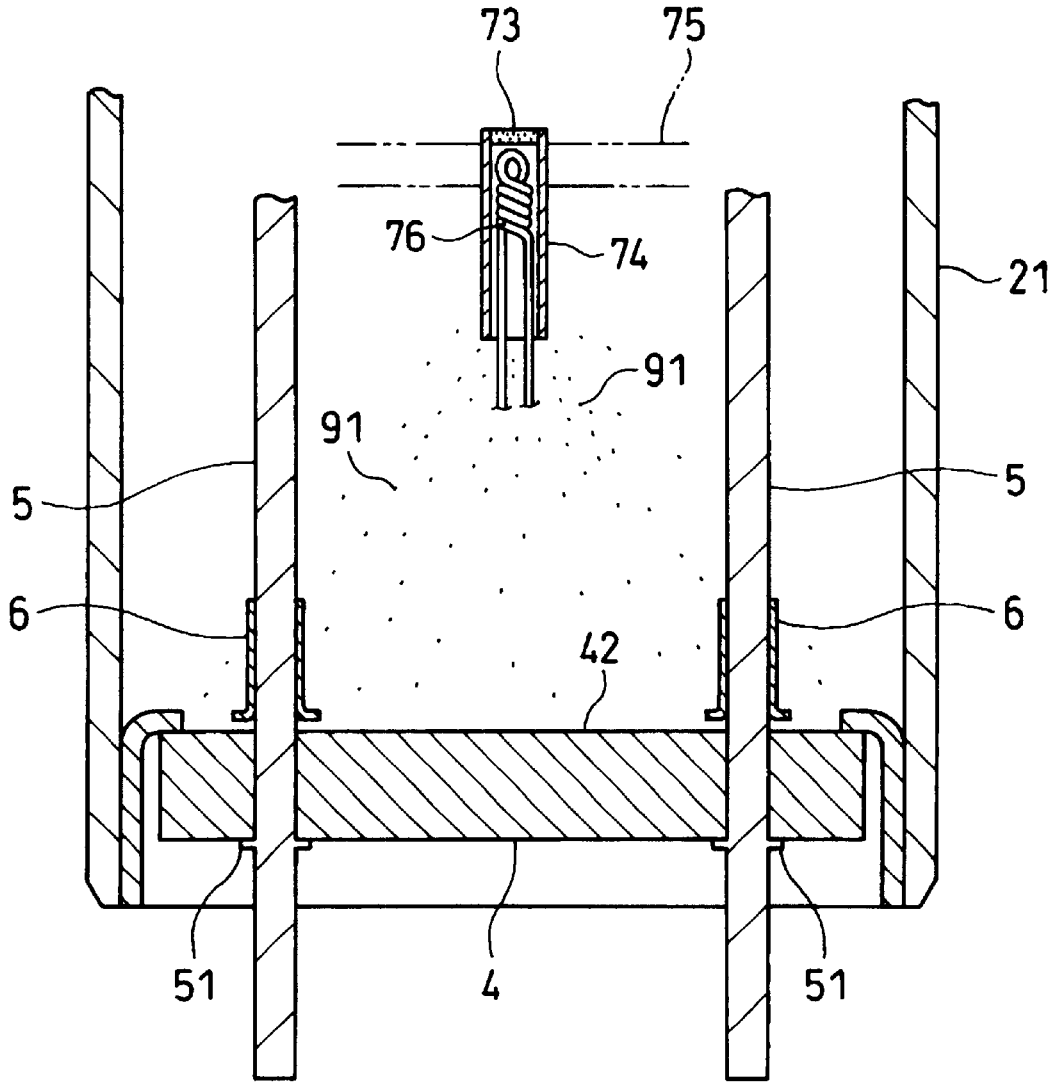
FIG. 2 is a view for explaining the operation of the X-ray tube according to the first embodiment.

When this X-ray tube 1 is continuously used over a long period of time, the heater 76, cathode 73, and the like heated to a high temperature generate conductive debris 91, as shown in FIG. 2. The debris 91 is scattered in the container 21 to attach to the circumferential surfaces of the pins 5, the inner surface 42 of the stem substrate 4, and the like.

Figure 3:
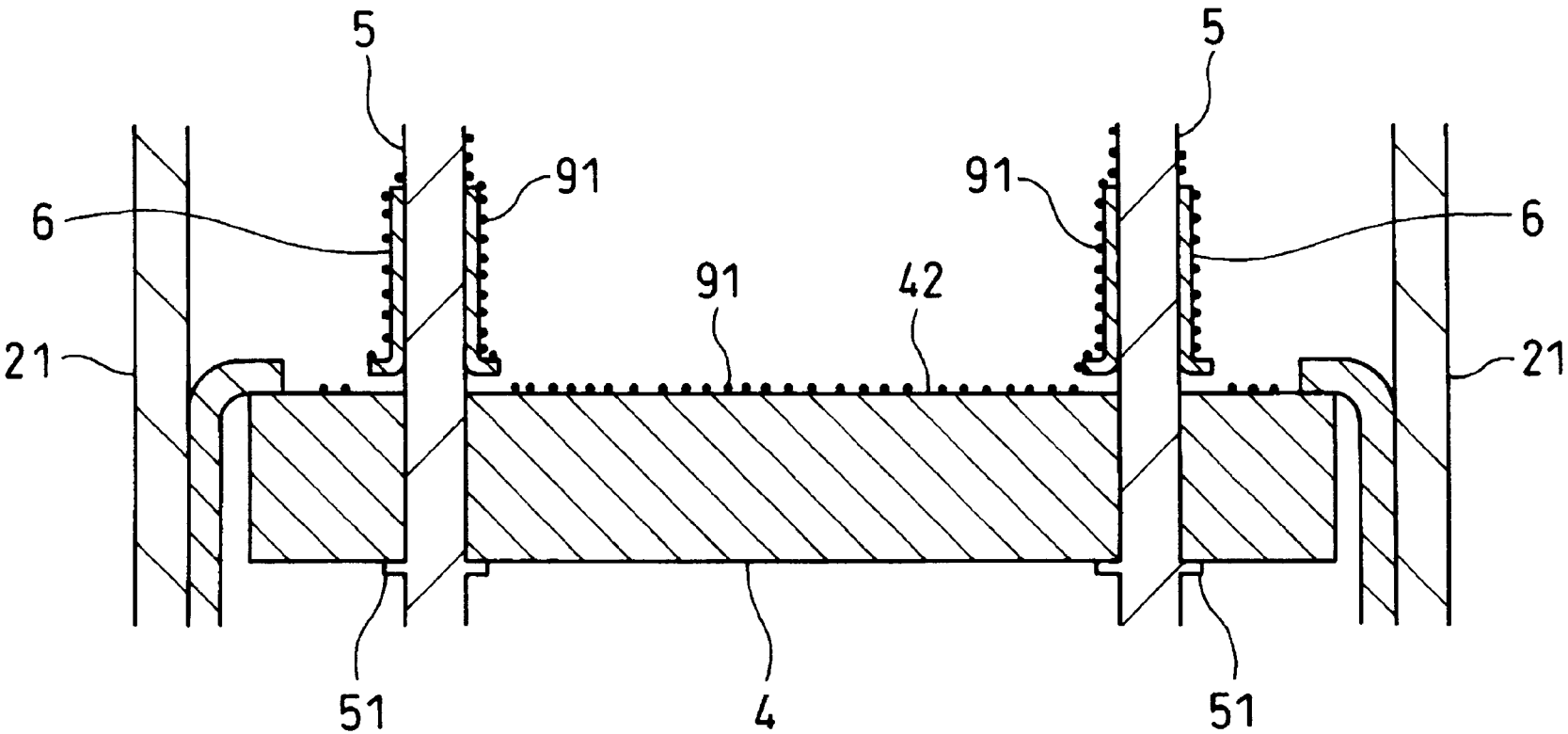
FIG. 3 is a view for explaining the operation of the X-ray tube according to the first embodiment.

Since the base portions of the pins 5 are covered with the pin covers 6, as shown in FIG. 3, even if the debris 91 is scattered toward them, the debris 91 does not attach to them. Thus, the pins 5 can be reliably prevented from being electrically connected and short-circuiting to each other through the debris 91 which has attached to the inner surface 42 of the stem substrate 4 and is deposited on them. Even after use over a long period of time, the X-ray tube 1 can stably operate without being adversely affected by the debris 91 generated by the heater 76 and cathode 73.

(Second Embodiment)

In the first embodiment, the X-ray tube according to the present invention is applied to a microfocus X-ray tube. However, the X-ray tube according to the present invention is not limited to this, but can also be a transmission type microfocus X-ray tube. Regarding the focal diameter, the present invention is not limited to an X-ray tube with a microfocus, but can be applied to an X-ray tube with any focal diameter. Even in this case, the same operation and effect as those of the X-ray tube 1 according to the first embodiment can be obtained.

The X-ray tube according to the present invention can be utilized as an X-ray source and, for example, can be utilized as a light source in an X-ray CT apparatus used for an industrial or medical application.

What is claimed is:

1. An X-ray tube in which a cathode is heated to emit electrons, and the electrons are bombarded against an anode target, thereby generating X-rays, characterized by comprising:

an insulating substrate mounted on an opening portion of a container housing said cathode;

a plurality of pins extending through said insulating substrate and adapted to supply a voltage into said container; and pin covers mounted on said pins in said container and arranged at positions away from a surface of said insulating substrate to cover base portions of said pins.

2. An X-ray tube according to claim 1, characterized in that each of said pin covers has a cylindrical portion mounted on said pin, and a flange projecting outward from said cylindrical portion.

3. An X-ray tube according to claim 1, wherein each of said pins has a collar formed on a circumferential surface thereof, said collar being fixed to said insulating substrate at an outer surface portion of said insulating substrate.

* * * * *